US005322104A

United States Patent [19]

Morey et al.

[11] Patent Number: 5,322,104

[45] Date of Patent: Jun. 21, 1994

[54] FLAIL DRUM MACHINES AND METHODS

[75] Inventors: Norval K. Morey; Milan W. Robison, both of Weidman, Mich.

[73] Assignee: Wood Technology, Inc., Winn, Mich.

[21] Appl. No.: 57,179

[22] Filed: May 4, 1993

[51] Int. Cl.[5] ..... B27L 1/00; B27L 7/00

[52] U.S. Cl. ..... 144/341; 144/2 Z; 144/208 J; 144/343; 144/249 R; 241/193

[58] Field of Search ..... 29/402.3, 402.8, 889.1; 241/192, 193; 144/2 Z, 208 R, 249 R, 249 A, 340, 341, 343

[56] References Cited

U.S. PATENT DOCUMENTS

| | | | |
|---|---|---|---|
| 1,552,498 | 9/1925 | Noyes | 144/208 J |
| 2,601,261 | 6/1952 | Carpenter | 144/208 J |
| 2,792,860 | 5/1957 | Watkins | 144/208 J |
| 3,342,426 | 9/1967 | Sackett, Sr. | 241/193 |
| 4,023,604 | 5/1977 | Stadnick | 144/208 J |
| 4,061,166 | 12/1977 | Larson | 144/208 J |
| 4,172,481 | 10/1979 | Brisson | 144/208 J |
| 4,214,616 | 7/1980 | Brisson | 144/208 J |
| 4,222,418 | 9/1980 | McCray et al. | 144/208 J |
| 4,572,258 | 2/1986 | Mischel | 144/208 J |
| 4,640,325 | 2/1987 | Vaders | 144/208 J |
| 4,690,187 | 9/1987 | Schmidt | 144/208 J |
| 4,711,280 | 12/1987 | Schmidt . | |
| 4,719,950 | 1/1988 | Peterson et al. . | |
| 4,787,431 | 11/1988 | Demlow . | |
| 4,889,169 | 12/1989 | Peterson et al. . | |
| 4,947,906 | 8/1990 | Schroeder . | |
| 5,148,844 | 9/1992 | Robison | 144/208 J |
| 5,193,597 | 3/1993 | Strong | 144/208 J |

FOREIGN PATENT DOCUMENTS

| | | |
|---|---|---|
| 10880 | 4/1901 | Denmark . |
| 122026 | 6/1945 | Switzerland . |
| 8201547 | 4/1986 | Switzerland . |

OTHER PUBLICATIONS

Translation of claims in Swedish 8201547 and 6 pages of translation of the specification.

*Primary Examiner*—W. Donald Bray
*Attorney, Agent, or Firm*—Learman & McCulloch

[57] ABSTRACT

A flail drum system has an upper rotary chain flail drum and a lower rotary chain flail drum longitudinally downstream from the upper drum. Wood product advancing mechanism on the machine frame moves the logs forwardly while spreading them and creates a downward pressure on the products at a first pinch point. The upper and lower flail drums are each driven in rotation about a generally horizontal axis transverse to the path of the log. There is a vertically fixed log support member longitudinally between the upper and lower flail drums and driven means for engaging and advancing the logs is provided on a vertically movable subframe which mounts the upper flail drum, longitudinally between the flail drums, for creating a downward pressure on the logs passing between the upper and lower flail drums and preventing raising and diving movement of the logs passing between the drums. The flail drums have a central shaft with scalloped rod support and spacer elements providing perimetral openings, through which chain supporting rods extend without engaging the elements, alternately with circumferentially spaced openings through which the rods extend and which support the rods. The chains are arranged in an axially progressive spiral array on the rods.

17 Claims, 6 Drawing Sheets

FLAIL DRUM MACHINES AND METHODS

FIELD OF THE INVENTION

The present invention relates to flail apparatus for delimbing and/or debarking wood products including trees, log slabs and logs, and particularly a plurality of side by side logs simultaneously.

BACKGROUND OF THE INVENTION

In producing chips from logs and small trees which are used in the paper industry to make pulp, it is desirable to remove any limbs and the bark prior to introducing the tree or log to a chipper for chipping the wood product into usable chips. Various flail drum systems have been used in conjunction with chippers and like processing machinery for many years, and have been proposed and used in many forms. For example, the following prior art patents, which are incorporated herein by reference, are concerned with various flail assemblies and their use:

U.S. Pat. No. 1,552,498, Noyes
U.S. Pat. No. 4,023,604, Stadnick
U.S. Pat. No. 4,061,166, Larson
U.S. Pat. No. 4,172,481, Brisson
U.S. Pat. No. 4,222,418, McCray et al
U.S. Pat. No. 4,572,258, Mischel
U.S. Pat. No. 4,787,431, Demlow
U.S. Pat. No. 4,889,169, Peterson et al
U.S. Pat. No. 4,947,906, Schroeder
U.S. Pat. No. 5,148,844, Robison The present invention is directed to a system of improved character, particularly for handling multiple small diameter logs fed in side by side relation, which positively controls the movement of the logs proceeding through the flailing chamber. The system enhances the bark removing capability of the machine, and enables the speedy and economic repositioning or replacement of the component flail drum parts which are subject to wear.

SUMMARY OF THE INVENTION

The present flail system incorporates upper and lower bark and limb removing flail drums to forcibly remove small limbs or limb stubs, and the bark, from the core portion of the logs, as the wood products are fed continuously through a flailing station. The station may be part of a mobile machine which also mounts a chipper to which the wood products are then fed, or the flailing station may itself constitute a separate mobile unit which is movable up to a position adjacent such a chipper.

In the machine of the present invention, a series of pressure controlled pinch points are provided to control the passage of a plurality of side by side logs to and past a vertically adjustable upper flail drum, and to and past a downstream lower flail drum.

One of the prime objects of the present invention is to provide a flail drum system which controls the travel of multiple wood stems as they proceed through the flail station to prevent the stems from moving vertically and laterally, and interfering with the bark removing operation.

Another object of the invention is to provide a system of the character described wherein the wood products are initially spread apart and pressure controlled at an initial pinch point located upstream of the upper flail drum, and then subsequently controlled at two subsequent pinch points located, respectively, between the flail drums, and downstream from the lower flail drum, by mechanisms which exert sufficient pressure to prevent any raising or diving movement of the wood product proceeding through the flail station.

Another object of the invention is to provide flail drums which have substantially all of the advantages of the drum disclosed in the present assignee's prior issued U.S. Pat. No. 5,148,844, while providing chains on the flail drum units which are relatively axially spirally mounted.

Still a further object of the invention is to provide a flail drum system utilizing elongate chain support rods which, when partly worn in certain axially spaced locations, can be removed and shifted angularly to other positions in the drum in which other axially spaced areas of the parts are subjected to wear, to provide a longer operable system which is so constructed that increased operating time is achieved before complete replacement of such wear parts is required, while still providing a system which can be readily disassembled, new parts substituted, and operation quickly resumed.

Still a further object of the invention is to design a log debarking flail machine which is capable of effectively debarking smaller diameter logs than previously, while still being capable of processing the larger logs efficiently.

Other objects and advantages of the invention will be pointed out specifically or will become apparent from the following description when it is considered in conjunction with the appended claims and the accompanying drawings.

GENERAL DESCRIPTION

Figure 1:
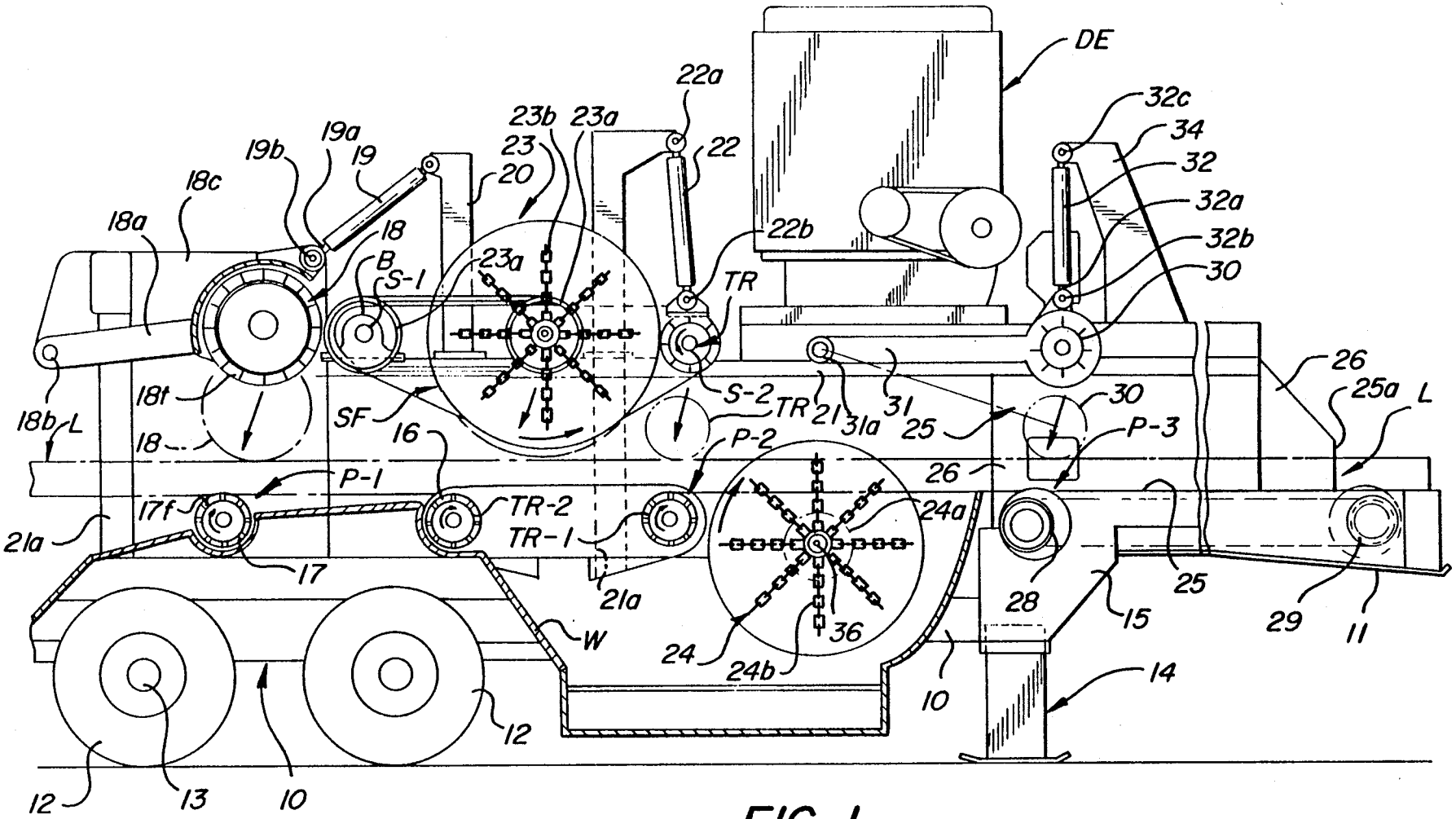
FIG. 1 is a schematic, side elevational view of the flailing machine with some parts being omitted, or designated in chain lines, for purposes of convenience of illustration.

Referring now more particularly to the accompanying drawings, and in the first instance to FIG. 1, I have shown a trailer vehicle, including a frame or bed 10 having a forwardly extending tow bar 11 adapted to be connected to a motive vehicle which can pull it along logging trails in the forest. The frame 10 may be supported for operation on wheels 12, rotatable on frame supported axles 13, and on lowerable front stabilizers 14, which are raiseable to a position within a housing 15 when not in use and the trailer is in transit. A floor conveyor assembly, generally designated 16, is provided to support the logs L and includes an upstream hydraulically driven, toothed lower spreader roll, generally designated 17, and a hydraulically driven toothed upper roll, generally designated 18, to further assist the logs to move into the machine and hold them in a horizontal planar array at what may be termed a first pinch point P-1.

Figure 2:
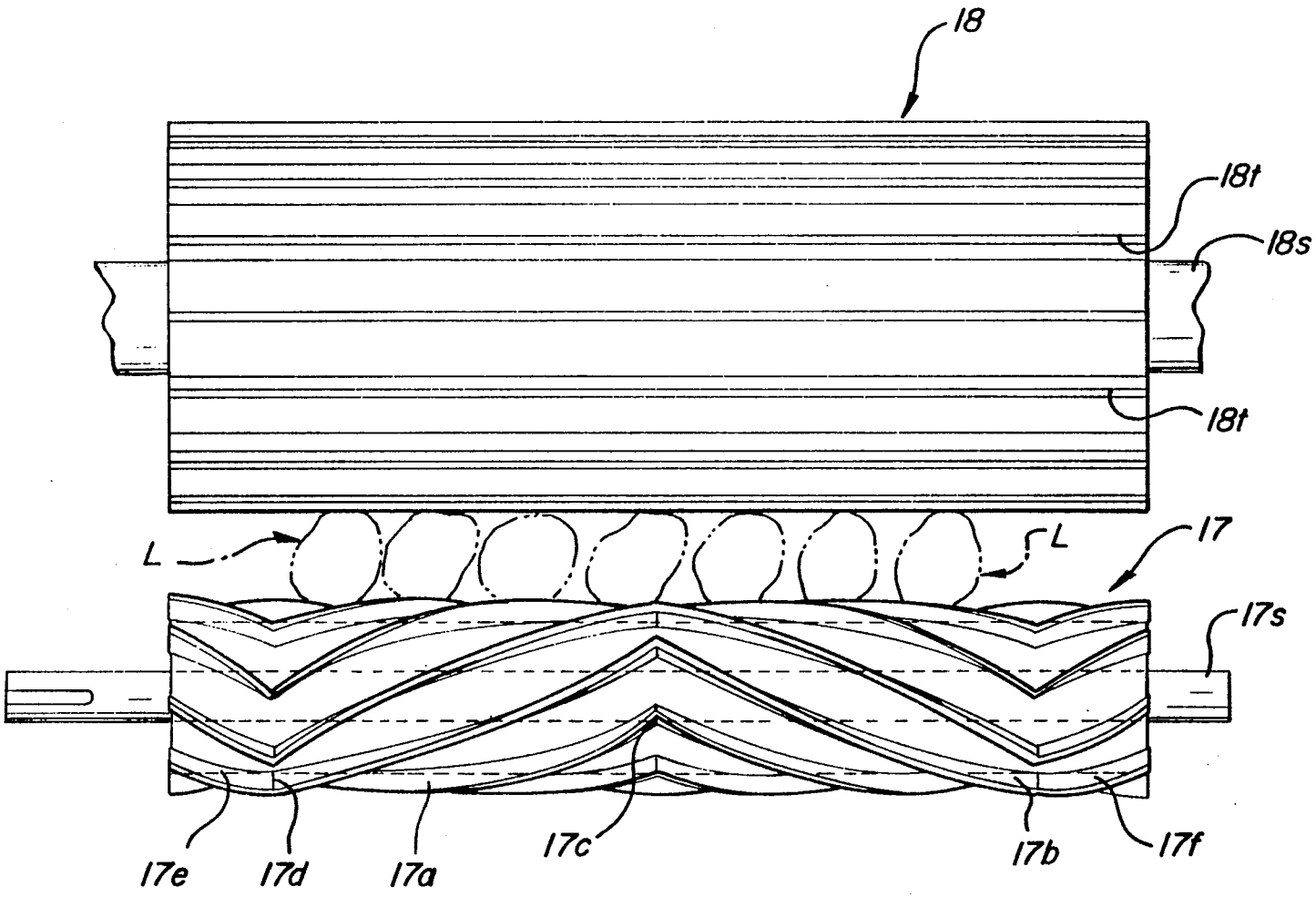
FIG. 2 is an enlarged, schematic, end elevational view of the feed wheel spreading mechanism utilized at the charge end of the machine.

The spreader roll 17 which is fixed to shaft 17*s* as FIG. 2 shows, has angular vanes or teeth 17*a* and 17*b*, provided to extend helically transversely outwardly from a transversely central juncture 17*c* to end junctures 17*d*. The vanes 17*a* and 17*b* spread the logs laterally or transversely to essentially provide a single layer of logs going through, and to present them in a manner to permit flailing of their sides. The vanes or teeth 17*e* and 17*f* are return vanes which tend to prevent the logs L from sliding laterally beyond the ends of roll 17.

It is to be understood that, typically, a boom with a grapple (not shown) will be utilized to pick up the logs and feed them into the inlet of the machine defined by the nip between lower roll 17 and upper roll 18. The lower roll 17 cannot move vertically, but the upper roll 18, which has circumferentially spaced vanes or teeth 18*t*, and is fixed to shaft 18*s*, is supported for vertical swinging travel on a front yoke 18*a*, having yoke arms pivoted at 18*b* to a frame supported bracket 18*c*. A hydraulic cylinder 19, which has its piston rod 19*a* connected to an extension of yoke 18*a* at 19*b*, is pivotally supported on a post assembly 20 supported by longitudinally extending subframe members 21. The members 21 may be supported from the frame 10 on vertical posts 21*a*. A considerable pressure is applied to upper roll 18 and the logs L as a result of the weight of yoke 18*a* and the roll 18 at the pinch point P-1 formed by rolls 17 and 18. In addition to the weight factor, substantial hydraulic pressure can be applied vertically via cylinder 19 on larger diameter logs.

As FIG. 1 indicates, a drive sheave 23*a* may be provided for driving an upper flail drum assembly, generally designated 23, which, with a downstream lower flail drum assembly, generally designated 24, spaced downstream from drum assembly 23 and supported on the open frame 10, constitutes a debarking and delimbing flail drum system disposed at what may be termed a flailing station FS. It is to be understood that the flail drum assemblies 23 and 24 are identical, except that the chain systems 23*b* of system 23 may be longer than the chain systems 24*b* of flail drum assembly 24. The assembly 24 is located slightly upstream from the assembly 23 which may be driven in a counter direction to the flail drum assembly 24, as indicated by the counterrotating arrows in FIG. 1, by a drive sheave 23*a* which is preferably mechanically driven from a diesel engine DE. The drum 24 is similarly driven via drive sheave 24*a* Material removed by the flail units 23 and 24 can fall to a paddle type endless debris conveyor DC, extending transversely to the machine, with inclined wall W assisting its passage.

The upper flail drum assembly 23 is mounted on a vertically swingable frame or yoke SF which is pivoted to swing vertically about a laterally extending shaft S-1, supported by bearings B. At the downstream end of frame SF, a toothed roller TR is mounted on a hydraulically driven shaft S-2 carried by suitable bearings on the frame SF. The roller TR cooperates with a hydraulically rotated, vertically fixed, toothed lower roll TR-1 to provide a second pinch point P-2 for preventing both upward and diving movement of the wood products, inasmuch as hydraulic cylinder 22, connected to the machine frame at 22*a*, and to swingable frame SF at 22*b*, exerts a considerable pressure to maintain the integrity of the pinch point P-2. It is the piston rod of the cylinder 22 which connects to the swing frame SF. Upstream of roll TR-1 is a similar hydraulically rotated, vertically fixed, toothed roll TR-2 cooperating with the rolls TR-1 and TR to advance the logs.

Downstream of flail drum assembly 24, is a log discharge conveyor unit, generally designated 25, having a convergent inlet chute 26 to receive the debarked and delimbed wood products, and an outlet 25*a* to direct debarked wood to a chipper or the like (not shown). Longitudinally spaced conveyor rolls 28 and 29, mounting a discharge conveyor chain 29*a*, are provided at the level of the bottom of chute 26, and an upper toothed roll 30 is provided to assist the feed of the wood products into chute 26. The toothed roll 30, which is mounted on a yoke 31 pivoted to the frame as at 31*a*, may be raised and lowered by the piston rod 32*a* of a hydraulic cylinder 32, which connects to yoke 31 at 32*b*. Cylinder 32 may be pivotally mounted at 32*c* on a frame supported bracket 34. It is the conveyor roll 29 which is driven and the idler roll 28 which cooperates with roll 30 to form the pinch point P-3.

Figure 8:
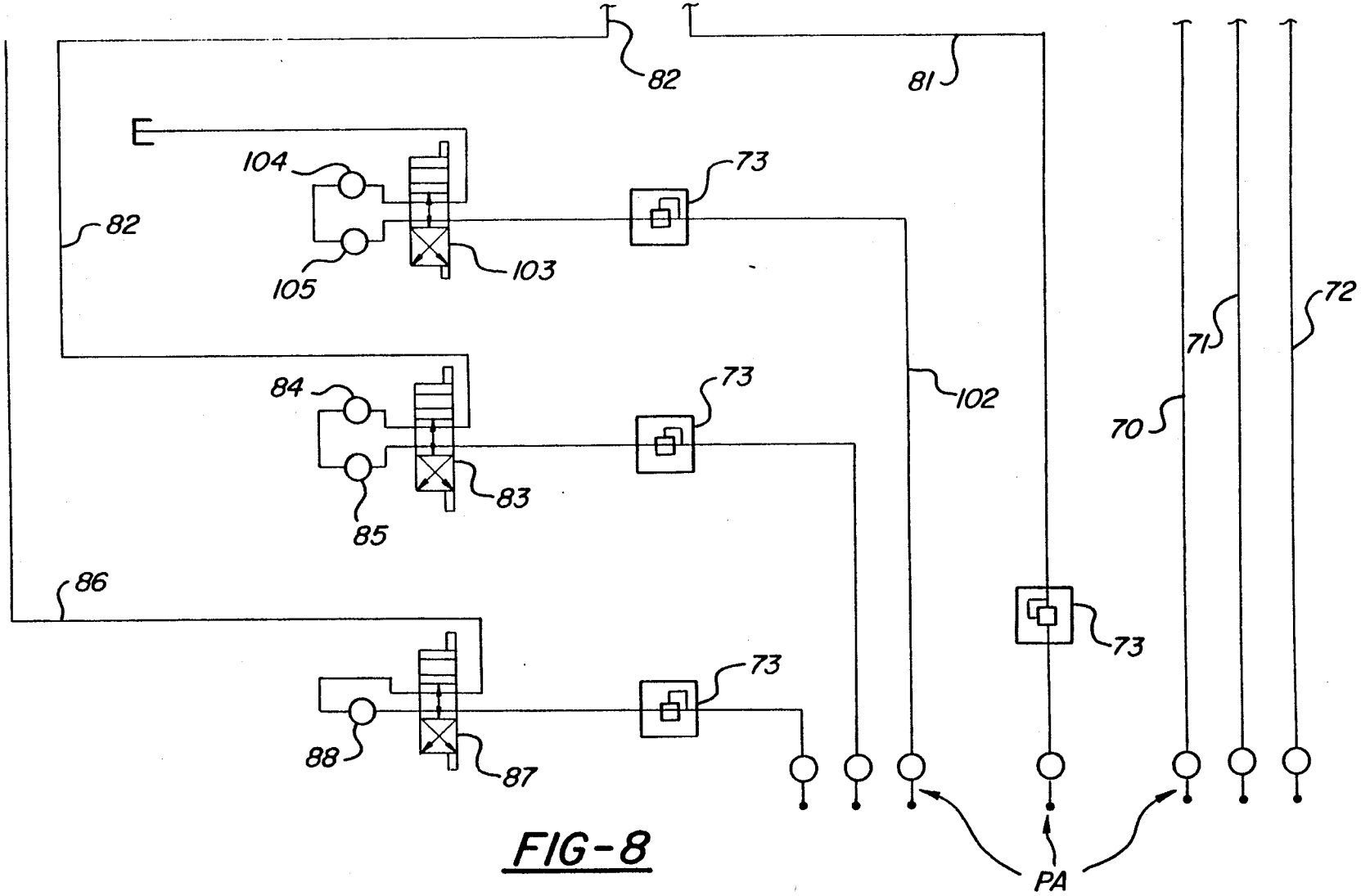
FIGS. 8 and 8A depict a schematic hydraulic circuit diagram.
Figure 8A:
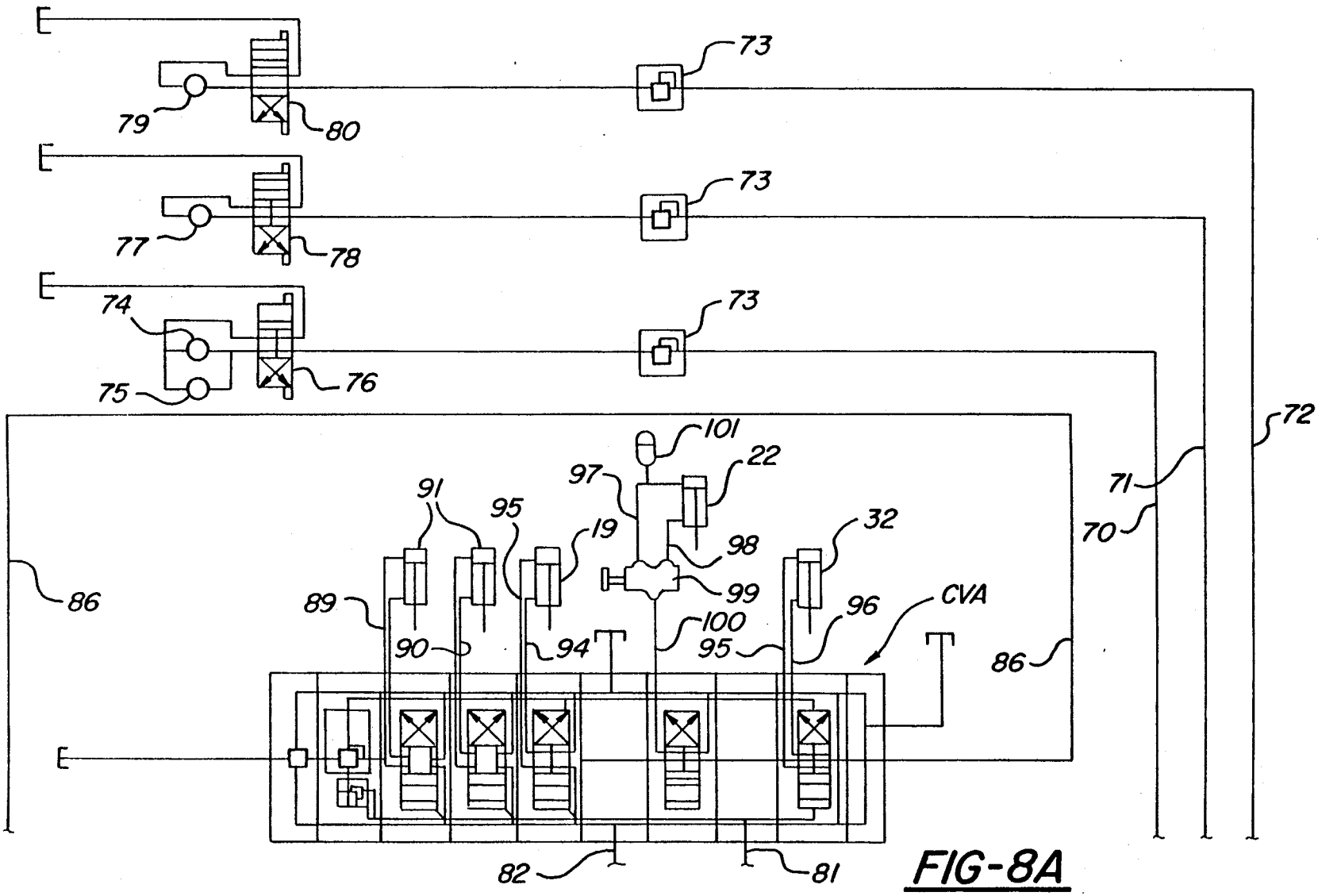

All of the log advancing rollers 17, 18, TR-2, Tr-1, TR, 29 and 30 are driven by conventional rotary hydraulic motors, to be further identified in FIGS. 8 and 8A, in a direction to advance the trees or logs through the flail station FS.

Referring now more particularly to the flail units 23 and 24, attention is directed to FIGS. 3–6, wherein their construction is described in more detail. Because the flail units are identical, except for the length of the flail chain systems, 23*b* and 24*b*, a description of the flail chain drum assembly 23 will suffice as a disclosure of both.

The assembly 23 includes a central shaft 36 (FIG. 3) having a drive key slot 37 (FIG. 5) for mounting the keyed drive sheave 23*a* which is driven by the sheave 23*s* connected to the diesel engine DE. As FIG. 5 particularly indicates, the shaft 36 is threaded at its ends as at 38 and 39 (FIG. 3), and a longitudinally extending keyway 40 is provided in the shaft 36 to receive a key 41.

Figure 7:
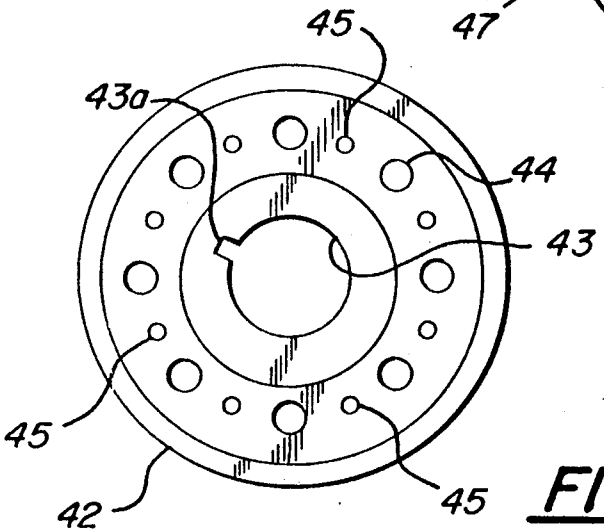
FIG. 7 is a end elevational view of the one rod end support member.

At one end of shaft 36, rod end support member 42, having a central opening 43 is provided with a key slot 43*a* so that it can be slipped over the shaft 36 and key 41. The end disc or member 42 is provided with a series of equally circumferentially spaced, rod-receiving openings 44 (FIGS. 3 and 7), i.e. eight, to receive longitudinally extending rods R, and is further provided with threaded bores 45 circumferentially between the openings 44 for a purpose to be later described. A positioning nut 46, threaded on the shaft thread 38, bears against the recessed shouldered wall 42*a* provided in member 42 to hold it in position.

Scalloped annular spacer members, generally designated 47 (see FIGS. 3–6), functioning also as rod support ring members, have shaft accommodating openings 48 with keyways 49, and pairs are assembled in progressively axially angularly displaced, i.e. 45 degree, abutting relation on the shaft 36. The members 47 have radially extending, peripheral recesses 50 provided between circumferentially spaced lobes 50*a* which have rod-receiving openings 51. The radially extending recesses or openings 50 are spaced circumferentially so that the recesses 50 in certain members 47 are in axial alignment with certain of the openings 44 and certain of the openings 51 in adjacent pairs of members 47. Thus, the elongate axially parallel rods R, when received in the openings 51 in certain spacers 47, extend freely centrally through the spacer recesses 50 in other spacers 47.

As in U.S. Pat. No. 5,148,844 a rod support plate 52 is provided on the shaft 36 adjacently inboard of the end members 42 and has rod receiving openings 53 in alignment with the openings 44. The progressive angular displacement of the pairs of members 47 provides chain receiving recesses 50 which are progressively angularly displaced so that the chain systems 23*b* and 24*b* are progressively disposed in spiral formation.

Provided on each of the rods R to extend radially outwardly from the rods R, are the chain systems 23*b* and 24*b*, which each comprise a pair of common link chains 54 and 55. These have, respectively, inner links 54*a*and 55*a*, and outer links 54*b* and 55*b*. The links of the chains 54 and 55, as shown, have successive links disposed at right angles one to the other and, as FIG. 3 indicates, the alternating links, beginning with the second links 54*c* and 55*c* are sidewisely adjacent one another.

Provided on the opposite end of the shaft 36 from end member 42, adjacent a like rod support plate 52 is an end member 56 (FIG. 3) which has circumferentially disposed blind bores 57 for receiving the ends of rods R. Centrally, the member 56 has a shaft accommodating opening 58, provided with a keyway 59 for receiving key 41. A nut 60 can be threaded on the threaded portion 38 of the shaft 36 until it comes into engagement with the recessed shoulder portion 61 of end member 56.

Figure 3:
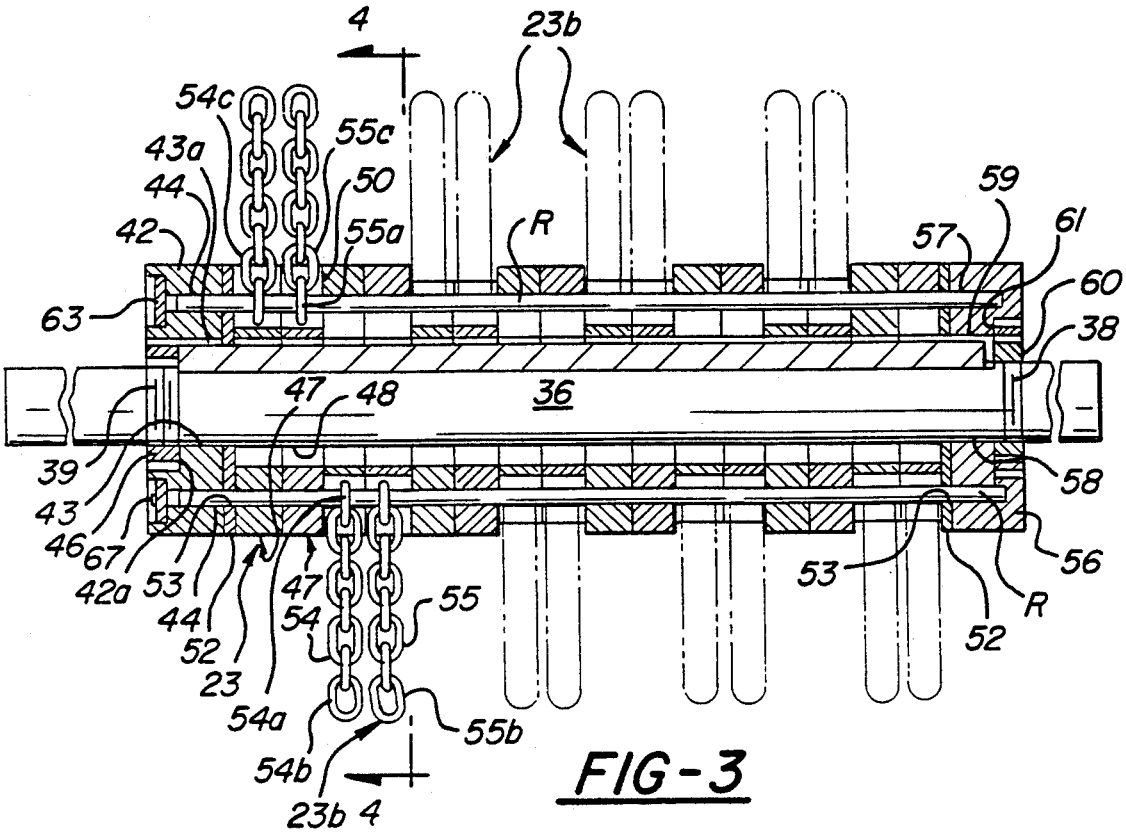
FIG. 3 is an enlarged, schematic, sectional, plan view, more particularly illustrating the flail drums employed in the machine, and taken on the line 3—3 of FIG. 4.

As FIG. 3 illustrates, the links 54*c* and 55*c*, when in side by side alignment, are a relatively close fit in the pockets formed axially between the pairs of members 47 and so the edges of links 54*c* and 55*c* tend to be guided by one another and by the radial walls of the members 47. With the pairs of chains 54 and 55 in this position of adjacency, they tend to mutually support one another and maintain their side by side alignment (although some turning on rods R can occur) and there is less wear than is encountered when chains are employed singly, because there is less deflection over the full lengths of the chains on rebound.

It has been found that the greatest chain wear occurs in the first links 54*a* and 55*a*, and in the outer three links of the chains. Worn chains from the assembly 23 which are required to be, for example, 13 inches in length, can after that wear, be reduced in length and used as the 8 inch links in the assembly 24.

Figure 6:
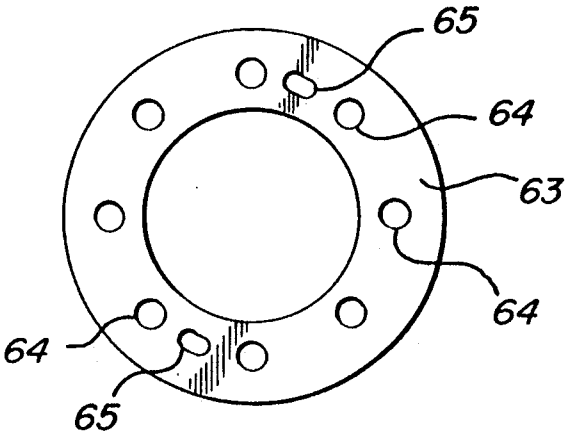
FIG. 6 is an end elevational view of the rod locking plate only.

As FIGS. 3 and 6 particularly illustrate, a locking plate or ring 63, which is rotatable relative to shaft 36, is used to lock off the openings or passages 44 in end member 42. The plate 63 which mounts within end member 42 has spaced passages 64 which circumferentially align with the openings 44 in one rotary position of plate 63 and permit the rods R to be simply pulled outwardly for replacement of any of the chains 54 and 55 and/or the repositioning of rods R. The plate 63 also has a pair of elongated slots 65 which can align radially with the threaded openings 45 in the end member 42 so that bolts 67 can thread into a diametrically opposed pair of the openings 45. When the plate 63 is rotated slightly from a rod aligned position, the ends of rods R are covered by the plate portions 68 between passages 64, the slots 65 being of somewhat less width than the diameter of the rods R in those plate portions 68 which have the slots 65. In its rod blocking, operative position, plate 63 is secured to rotate with end member 42. The parts and method of locking are well described in U.S. Pat. No. 5,148,844.

In FIG. 8 and 8A, a schematic hydraulic diagram is disclosed which incorporates a pump assembly PA for powering the various hydraulically driven elements of the machine. It is to be understood that the pump assembly PA comprises a conventional hydraulic pump, driven by the diesel engine DE, with the various output lines shown. The hydraulic line 70 leads through a pressure control relief valve 73 to a pair of reversible hydraulic motors 74 and 75 for driving the yoke feed wheel 18 in rotation via a directional control valve 76. The hydraulic line 71 leads via relief valve 73 to a reversible hydraulic motor 77 for driving the bottom feed wheel 18 in rotation through a directional control hydraulic valve 78. The flail yoke feed wheel TR, which is toothed in the manner of roll 18, is driven in rotation by a reversible hydraulic motor 79, via a directional control hydraulic valve 80 communicating with line 72 in which a like pressure control relief valve 73 is provided.

A control valve assembly, generally designated CVA, is provided to directionally control the supply of hydraulic pressure fluid to other elements in a manner to be described. The valve CVA is supplied with hydraulic fluid through a line 81 in which a pressure relief valve 73 is provided, and by a hydraulic line 82, having a pressure control relief valve 73 upstream from a directional control valve 83 which supplies hydraulic fluid to a reversible hydraulic motor 84 powering the outfeed conveyor 25, and to a reversible hydraulic motor 85 powering the front yoke feed wheel 17 in rotation. The valve CVA is also supplied with hydraulic fluid by a hydraulic line 86 which incorporates a relief valve 73, and a directional control valve 87 controlling the reversible hydraulic motor 88 which drives the debris conveyor DC.

Still further, the valve CVA, via hydraulic lines 89 and 90, controls the hydraulic cylinders 91 for raising and lowering the front stabilizers 14. The hydraulic cylinder 19 for raising and lowering the front yoke 18*a* communicates with the valve CVA via hydraulic lines 93 and 94. Lines 95 and 96 connect the control valve CVA to the hydraulic cylinder 32 for moving the rear yoke 31 upwardly and downwardly. The cylinder 22, for swinging the flail yoke SF vertically, communicates with the control valve CVA via hydraulic lines 97 and 98 through a push and pull control rod-operated selector valve 99 connected in a hydraulic line 100 leading to valve CVA. Provided to increase the load exerted on advancing wheel TR at pinch point P-2, is a nitrogen gas accumulator 101. This occurs with the conventional selector valve being operated to hydraulically lock out the rod end of the cylinder 22, once it has raised yoke SF, the accumulator 101 exerting a predetermined down pressure on the head or base end of the cylinder. This occurs when the line 98 is blocked off by the selector valve 99 to effectually lock the piston rod at a particular raised position to process a selected diameter of log, line 97 remaining open to line 100. Operation of the valve 99 to communicate both lines 97 and 98 with line 100, of course, unlocks the piston rod of cylinder 22.

The downward force exerted at pinch point P-1 is a function of the weight of the yoke 18*a* plus the pressure applied by cylinder 19, as indicated previously. Typically, the system is set so that a pressure of 500 p.s.i. can be exerted by the cylinder 19. At the yoke 31, cylinder 32 is capable of exerting a down pressure of about 800 p.s.i. When approximately eight inch diameter logs are being processed, approximately 2070 p.s.i. is exerted downwardly by the feed wheel TR at pinch point P-2. The amount of force exerted by the weight of the yoke assembly SF and by cylinder 22 at critical pinch point P-2 is augmented by the force exerted by the accumulator 101 which is precompressed to exert a down pressure of 150 p.s.i. when the machine is processing two inch diameter logs. When the selector valve is then moved to unlock the rod of cylinder 22 and permit the wheel TR to raise to accommodate logs larger than the minimum two inch diameter logs, the accumulator is further compressed to exert an increased down pressure against the piston head. When the selector valve 99 is operated to permit twenty-three inch diameter logs to be accepted, a pressure in the neighborhood of 2500 p.s.i. is being exerted downwardly at pinch point P-2 by the advancing wheel TR. It is estimated that the accumulator adds a down force of 40 p.s.i. each time the selector valve 99 is operated to raise the wheel TR an inch and compress the accumulator 101 further. The system exerts a greater downward force at pinch point P-2 to prevent raising and diving movement of the logs between the flail drums, 23 and 24 and to prevent the logs L from moving laterally out of spread position. In extreme down position, the feed wheel TR clears the roll TR-1 by one and one-half inches so the machine, for practical purposes, is capable of debarking wood which may be as little as two inches in diameter. In uppermost position, it can accommodate wood products which are twenty-three inches in diameter, and the system creates the larger vertical force which is necessary to maintain control of such larger diameter logs.

Finally, a hydraulic line 102 leads through a relief valve 73 to a control valve 103 which controls the supply of fluid to reversible rotary hydraulic motors 104 and 105 to drive the bottom feed wheels TR-1 and TR-2 at log advancing speeds.

THE OPERATION

Logs L are fed endwisely between the feed roll members 17 and 18 at the rear of the machine in FIG. 1 and spread by the rolls 17 and 18. They travel inwardly in planar relationship between the lengths of the chain systems **23*b* and 24*b* of the respective flail assemblies 23 and 24. The flail assembly chain systems 23*b* tend to push the spread logs L endwisely inwardly and downwardly while the chain systems 24*b*, which operate in a clockwise direction in FIG. 1, tend to push it inwardly and upwardly. For systems debarking mainly large diameter logs, the drum 24 may be driven in an opposite direction. As a plurality of side by side, generally parallel logs, for example, proceed in the path to flail station FS, the spirally oriented flail chain systems 23*a* and 24*a*, revolving at a rapid rate of speed, typically in the neighborhood of 500 revolutions per minute, flail off limbs, and flail away the bark to leave log cores which effectively are completely free of bark. Since the flail drums are longer than the array of logs is wide, the sides, as well as the top and bottom surfaces, of the end wood products in the array are fully engaged by the chains. The debarked cores then can move into the chipper chute 26**, which converges them before they pass to a downstream chipper from whence the chips are ejected in an air stream out the chipper outlet opening to a waiting van or the like. Loose bark, limbs and limb fragments, and any fragments of chain, can simply fall by gravity to the transversely extending debris conveyor DC provided to convey material to the sides of the unit.

Figure 4:
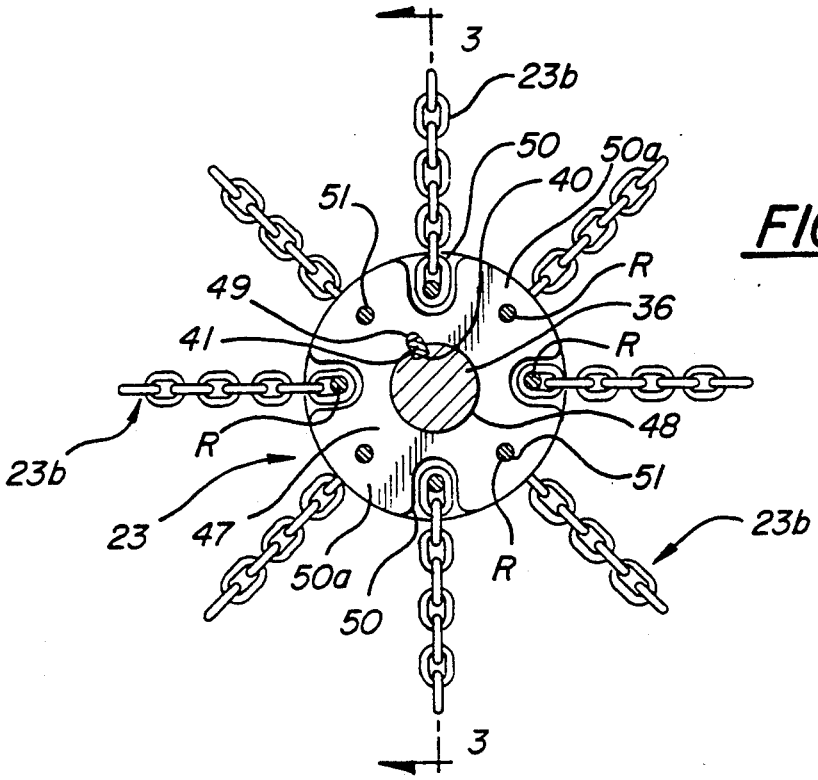
FIG. 4 is a transverse sectional view taken on the line 4—4 of FIG. 3.
Figure 5:
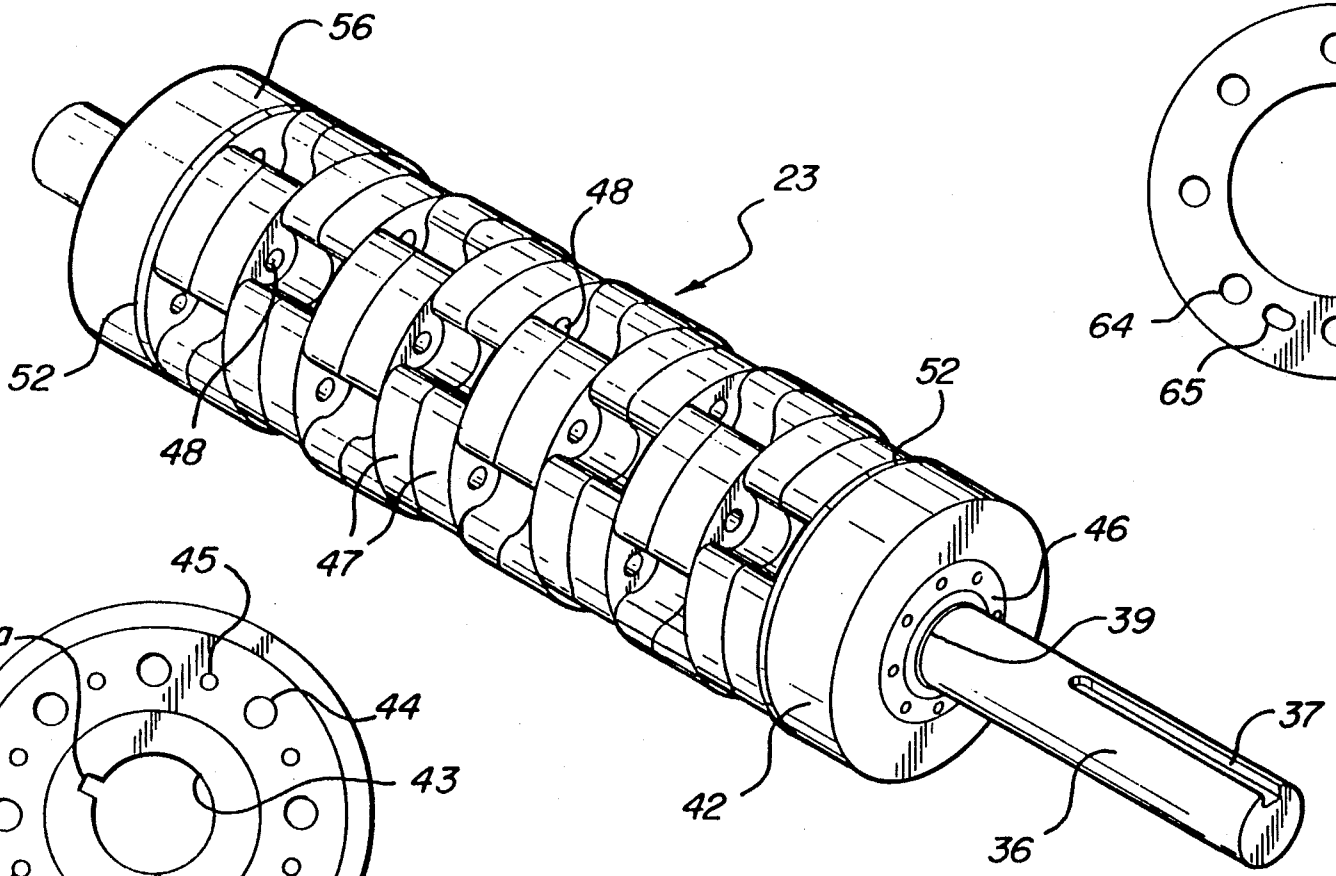
FIG. 5 is a perspective elevational view of certain parts of the flail drum only, with other parts thereof omitted in the interest of clarity of illustration.

Whereas, previously, flail drums of a different design have lasted for relatively short periods, it is expected that each component of the present flail drum assembly will last longer. All of the component parts shown in FIG. 3–5 are readily replaceable, either individually, or even in large part collectively, when replacement is required, and within a relatively short period of time so that the machine need not be down for any substantial period of time. The replacement of chains is simply accomplished by backing off the bolts 67, slightly revolving the end locking plate 63 to access the rods R, removing the rods R involved to remove the worn chains, and then reinserting the rods through fresh chains and relocking plate 63 in rod-blocking position. When it is observed that the rods R have become worn at chain holding locations, they can be removed in the same way and shifted angularly to a new set of aligned openings 44 and 48 so that different longitudinal sections of the rods R hold the chains, before complete replacement is necessary. Because each operator will maintain an inventory of these compact, relatively small parts, worn parts can be easily replaced and the device very readily reassembled and locked in operative position once again.

It is to be understood that the embodiments described are exemplary of various forms of the invention only and that the invention is defined in the appended claims which contemplate various modifications within the spirit and scope of the invention.

What is claimed is:

1. In a flail drum system including a frame; a sub-frame mounted for vertical travel thereon; an upstream upper rotary chain flail drum mounted on said sub-frame, and a lower rotary chain flail drum supported by said frame spaced longitudinally downstream from said upper drum for cooperatively delimbing and/or debarking a plurality of spread wood products; a wood product advancing mechanism on said frame for moving the wood products forwardly in a generally horizontal pat and creating a downward pressure on the products at a first pinch point; said upper rotary chain flail drum being disposed above the path downstream from said first pinch point and mounted to rotate about a generally horizontal axis transverse to the path; said lower rotary chain flail drum being disposed below the path generally longitudinally adjacent to the upper drum and mounted to rotate about a generally horizontal axis transverse to the path; a frame supported log support member positioned below said path longitudinally between said upper and lower flail drums; and drive mechanism for driving the advancing mechanism and for rotating said flail drums; the improvement wherein:

(a) driven member for engaging and advancing said logs is provided on said sub-frame downstream from said upper flail drum beyond the reach of said upper drum rotary chains and short of the reach of said lower drum rotary chains for creating a downward pressure on the wood products vertically opposite said log support member longitudinally at a second pinch point between said upper and lower flail drums for controlling the travel of the wood products moving from the upper flail drum to the lower flail drum and preventing raising and diving movement of the longitudinal ends of the logs passing between said upper and lower drums.

2. The system of claim 1 wherein said sub-frame is a generally longitudinally extending frame; said frame being pivotally supported at a location upstream from said upper flailing drum for vertical swinging movement about a transverse axis and having a front end extending beyond said upper flailing drum; and said driven means includes a wood advancing roller on said front end of the frame downstream from said upper flail drum and upstream of said lower flail drum; and a hydraulic cylinder assembly is connected between said frame and sub-frame to create a downward force maintaining the wood advancing roller in position to prevent raising and diving movement of the wood product at said second pinch point.

3. The system of claim 2 wherein said wood product advancing mechanism includes a driven toothed roller spaced longitudinally from said upper flail drum.

4. The system of claim 3 wherein a downstream toothed roller is mounted for vertical travel downstream from said lower flail drum, a downstream wood product advancing mechanism is provided downstream from said lower flail drum and includes a downstream endless member vertically opposite said downstream toothed roller, and a second hydraulic cylinder assembly is connected to said downstream toothed roller to create a downward force at a third pinch point between said downstream toothed roller and endless member, just downstream from said lower flail drum.

5. The system of claim 3 wherein said wood product advancing mechanism includes a vertically movable, rotating, spreading roller assembly upstream from said upper flail drum having a spreading roller with angular vanes for spreading said logs transversely as they are fed into the system and a cooperable roller above it; said spreading roller assembly and cooperating roller defining said first pinch point; and a hydraulic cylinder assembly is connected between said frame and cooperating roller for maintaining vertical downward pressure on said wood product at said first pinch point 6. The system of claim 5 wherein said downstream wood product advancing mechanism extends through a convergent housing downstream from said lower flail drum for converging said logs in preparation for feeding them to a chipper.

7. The system of claim 1 wherein each rotary chain flail drum includes a central shaft connected to be driven by said drive mechanism; axially parallel, circumferentially spaced generally axially parallel rods radially spaced from said shaft and supported thereon for rotation therewith; a series of scalloped rod support and spacer elements providing radially inwardly extending openings, through which said rods extend without engaging said spacers, alternately with circumferentially spaced openings through which said rods slidably extend and which support said rods; and radially extending, circumferentially spaced chains comprising a series of connected loop links with radially inner and outer terminal ends, the inner terminal ends of the chains comprising closed links through which said rods extend and chains being arranged in an angularly displaced, axially progressive spiral array on said rods, the outer terminal ends of the chains extending sufficiently beyond said scalloped elements to freely contact wood product moving in said path.

8. The system of claim 7 wherein said scalloped elements have four lobes, and said rods are spaced apart 45° circumferentially.

9. The system of claim 7 wherein said scalloped elements are each made up of a pair of aligned scalloped discs, and a pair of side by side chains are received in the openings between lobes thereof.

10. A flail drum for a flail drum system operable for delimbing and/or debarking a plurality of spread wood products at a flailing station wherein there is forwarding mechanism for moving the wood products forwardly in a generally horizontal path, a rotary chain flail drum disposed adjacent to the path and mounted to rotate about an axis transverse to the path, an opposite rotary chain flail drum disposed adjacent the path and mounted to rotate about an axis transverse to the path, and drive mechanism for driving the forwarding mechanism to move wood product in said path past said flail drums and for rotating said flail drums; comprising:

(a) a central shaft connected to be driven by said drive mechanism;

(b) circumferentially spaced, generally axially parallel rods radially spaced from said shaft and supported thereon for rotation therewith;

(c) circumferentially scalloped spacers and rod support elements connected to rotate with said shaft and providing radially inwardly extending recesses, through which said rods extend without engaging said spacers, and further providing circumferentially spaced openings through which said rods slidably extend and which longitudinally support said rods; and (d) radially extending, circumferentially spaced chains arranged in an angularly displaced, axially progressive spiral array on said rods, the outer terminal ends of the chains extending sufficiently beyond said rings to freely contact wood product moving in said path.

11. The drum of claim 10 wherein said scalloped spacers and rod support elements define a series of radially outwardly projecting lobes between said recesses; and rod support openings, sized to slidably pass certain of said rods while supporting them, are provided through said lobes, and while other rods pass freely through said recesses between lobes.

12. The drum of claim 11 wherein rod support end discs having openings for supporting said rods are provided to rotate with said shaft and sandwich said scalloped elements between them.

13. The drum of claim 12 wherein said scalloped elements are provided in progressive angularly offset relation to provide the recesses between lobes in axially progressive spiral formation.

14. The drum of claim 13 wherein said scalloped elements have four lobes and said rods are spaced apart 45° circumferentially.

15. The drum of claim 14 wherein said angularly offset spacers and rod supporting elements are each made up of a pair of aligned scalloped elements, and a pair of side by side chains are received in the scalloped openings between the lobes thereof.

16. A method of operatively restoring flail chain supporting rods worn at axially spaced portions as a result of chain contact and mounted in a flail drum operable for delimbing and/or debarking wood products, comprising trees and logs, at a flailing station wherein forwarding mechanism moves the wood products forwardly in a path past a rotary chain flail drum disposed adjacent to the path and mounted to rotate about an axis transverse to the path, the flail drum having a central shaft, the rods being axially parallel, circumferentially spaced rods radially spaced from the shaft and supported thereon for rotation therewith, the flail drum having a series of progressively angularly displaced, circumferentially scalloped elements connected to rotate with the shaft and having lobes providing radially inwardly extending recesses in spiral formation through which the rods extend without engaging the lobes, there being circumferentially spaced openings in the lobes slidably receiving and longitudinally supporting said rods and radially extending, circumferentially spaced chains comprising a series of connected loop links with radially inner and outer terminal ends, the inner terminal ends of the chains comprising closed links situated in said recesses between lobes in spiral formation through which the rods freely extend, the outer terminal ends of the chains extending sufficiently beyond the scalloped elements to freely contact wood product moving in the path, end members on said shaft, one of said end members having circumferentially spaced through passages in which the ends of said rods are received, and a lock assembly movable from a position covering said passages to a position in which it does not, the steps of:

a. moving said lock assembly from a position in which it blocks the passages in said end member to a position in which it does not;

b. withdrawing rods endwisely from the chain links and drum to free chains formerly supported thereon;

c. inserting said rods in different supporting passages in said end member openings, through different lobes, and through different recesses between said lobes through the inner closed links of chains positioned in the recesses between lobes to expose different unworn axial portions of the rods to the chains; and d. moving said locking assembly to block the rod ends in said end member passages.

17. In a flail drum system including a frame; a subframe mounted for vertical travel thereon; an upper rotary chain flail drum mounted on said sub-frame, and a lower rotary chain flail drum supported by said frame spaced longitudinally from aid upper drum for cooperatively delimbing and/or debarking a plurality of spread wood products; a wood product advancing mechanism on said frame for moving the wood products forwardly in a generally horizontal path and creating a downward pressure on the products at a first pinch point; said upper rotary chain flail drum being disposed above the path downstream form said first pinch point and mounted to rotate about a generally horizontal axis transverse to the path; said lower rotary chain flail drum being disposed below the path generally longitudinally adjacent to the upper drum and mounted to rotate about a generally horizontal axis transverse to the path; a frame supported log support member positioned below said path longitudinally between said upper and lower flail drums; drive mechanism for driving the advancing mechanism and for rotating said flail drums; a drive member for engaging and advancing said logs provided on said subframe longitudinally spaced from said upper flail drum, beyond the reach of said upper drum rotary chains and out of the reach of said lower drum rotary chains, for creating a downward pressure on the wood products vertically opposite said log support member at a second pinch point longitudinally between said upper and lower flail drums which controls the travel of the wood products moving between the upper flail drum and the lower flail drum and prevents raising and diving movement of the longitudinal ends of the logs passing between said upper and lower drums.

* * * * *

UNITED STATES PATENT AND TRADEMARK OFFICE

CERTIFICATE OF CORRECTION

PATENT NO. : 5,322,104

DATED : June 21, 1994

INVENTOR(S) : Norval K. Morey, et al

It is certified that error appears in the above-indentified patent and that said Letters Patent is hereby corrected as shown below:

Column 3, line 55, change "24a" to -- 24a. --.

Column 8, line 60, change "(a) driven" to -- (a) a driven --.

Column 12, line 9, change "aid" to -- said --;

line 16, change "form" to -- from --;

line 26, change "drive" to -- driven --.

Signed and Sealed this

Twentieth Day of September, 1994

Bruce Lehman

*Attest:*

BRUCE LEHMAN

*Attesting Officer*

*Commissioner of Patents and Trademarks*